US005405192A

United States Patent [19]

McGrath

[11] Patent Number: 5,405,192

[45] Date of Patent: Apr. 11, 1995

[54] MODULAR BOOTH DISPLAY ASSEMBLY

[76] Inventor: Stephen E. McGrath, 64 Carl Crescent, Scarborough, Ont., Canada, M1W 3R2

[21] Appl. No.: 162,329

[22] Filed: Dec. 7, 1993

[51] Int. Cl.[6] ..... A47B 87/00

[52] U.S. Cl. ..... 312/108; 312/258; 312/259; 312/262

[58] Field of Search ..... 312/108, 111, 198, 258, 312/259, 262

[56] References Cited

U.S. PATENT DOCUMENTS

| | | | |
|---|---|---|---|
| 1,384,880 | 7/1921 | Asher | 312/108 X |
| 2,299,766 | 10/1942 | Rosenthal | 312/259 |
| 2,323,103 | 6/1943 | Triana | 312/259 X |
| 2,583,931 | 1/1952 | Cummings | 312/262 X |
| 2,675,287 | 4/1954 | Sitler | 312/111 |
| 2,771,334 | 11/1956 | Wahlbom | 312/258 X |
| 2,808,305 | 10/1957 | Jackson | 312/258 X |
| 3,837,719 | 9/1974 | Barron | 312/259 X |
| 4,519,318 | 5/1985 | Weldon-Ming | 312/259 X |

*Primary Examiner*—Jose V. Chen
*Assistant Examiner*—Rodney B. White
*Attorney, Agent, or Firm*—Jane Parsons & Associates

[57] ABSTRACT

Modular display booth units are made from an upstanding bent sheet body portion located at its top and bottom in respective depending and upstanding lips of counter top and tray portions. Inside the body portions, rails extend from side to side. Hooked ends latch into latching apertures in the side wall and the side wall of any adjacent unit to link them together. Special angled joining units are provided to allow the units to be joined to form elongate assemblies of varying configuration.

9 Claims, 7 Drawing Sheets

MODULAR BOOTH DISPLAY ASSEMBLY

BACKGROUND OF THE INVENTION

1. Field of the Invention

This invention relates to modular display booth assemblies and kits for making such booth assemblies.

2. Acknowledgement of Prior Art

Display booths of the type comprising a small counter top and front and side vertical panels, possibly with vertical poles extending upwardly along the counter top to carry advertising or decorative material, are well known. Such display booths may be made from paper board carried on a frame work or from sheet metal or other materials. the poles extending upwardly from the counter top frequently carry display umbrellas or banners. Such display booths are dimensioned to be the convenient for operation by a single person.

Other types of known display booths include knock-down displays for use in trade shows, catering displays, temporary structures for the serving of drink or food and the like. Many of these displays have, as their basis, table tops which are supported on trestles and are located adjacent one another in any desired configuration. Frequently table cloths and drapery are used to create a decorative effect and to hide the space under the table which may be used for storage. Other display assemblies of this type may be very sophisticated and custom built to the specifications of the user. The materials used in custom building may be any of a variety of materials for example fibre board, chipboard, cardboard, metal sheet, and other materials. Plastics materials may have been considered but generally are not known to be used due to difficulties in warping, rigidity, stability, etc.

The design of display booth assemblies for the serving of alcoholic liquor presents particular difficulties since, in at least jurisdictions, it is necessary to physically latch adjacent units of an assembly together so that it is not easy for inebriated or over enthusiastic consumers to push aside the booths to allow access to liquor stored beneath the counter tops. Plastics materials booths may have been considered wholly unsuitable for this purpose due to the lightness of the material and the ease of pushing aside such booths.

The present inventor has addressed the problem of providing display booths in plastics material which may be easily recycled and the problem of providing a modular display booth system which may be assembled in a variety of different arrangements in a manner both aesthetic and practical.

SUMMARY OF THE INVENTION

According to the invention, a modular display booth assembly comprises a plurality of adjacent floor standing display units, a first one of said display units comprising a wide unit including an upright portion of rigid plastics sheet material having at least one front panel, side panels and at least one back panel hinged together through coined hinge lines, a lower tray portion having an upstanding lip confining lower margins of said front, side and back panels, and an upper counter top portion having a depending lip confining upper margins of said front, side and back panels; said upstanding lip and said lower margins being latched to lugs projecting inwardly on said upstanding lip and slots in the lower margins and the upstanding lip; said depending lip and said upper margins being latched through lugs projecting inwardly on said depending lip and slots in said depending lip; at least one, preferably two, spacer bar extending between side panels of said first one of said display units, said spacer bar having hooked end each of said hooked ends engaging in an aperture in a corresponding one of said side panels of said first one of said display units and into an aperture in a corresponding side panel of a second one of said display units to latch said first and second ones of the display units together. The spacer bars support a shelf.

A second one of said display units is of similar structure to said first one of said display units or may be of other structure, for example, the structure of a joining unit herein after described.

A hooked end of one of the spacer bars of the first display unit and a hooked end one of the spacer bars of the second display unit engage in a single aperture in one of the side panels of the first one of said display units and in a single aperture in an adjacent side panel of the second one of the display units to hold the units together. The back of the unit may be open or two back panels may be provided, each one of the back panels extending from one of said side panels. There may be access to the interior between the back panel.

An upright strengthening strut may be provided between the lower tray portion and the counter top portion in the access aperture between the back panels.

A joining unit has a joining front panel having a front width and joining side panels hinged to the front panel through coined hinge lines, at least one joining back panel flush with a back plane of the unit or the back edge having a back plane width less than the front width, a lower tray portion having an upstanding lip confining lower margins of said joining front and joining side panels, and an upper counter top portion having a depending lip confining upper margins of said joining front and joining side panels, at least one of the joining side panels being located adjacent to a side panel of a first one of said display units and being engaged therewith by a hooked end of at least one of the spacer bars of said first one or said second one of said display units engaging in an aperture in said one of said joining side panels.

The side panels of the joining units may meet at a vertical corner whereby said second one of said display units has a generally triangular horizontal cross section. The angle between joining side panels of said third one of said display units may be substantially 90 degrees. The inventor also includes a kit making the assembly.

Conveniently the units are formed from polyethylene or polypropylene.

BRIEF DESCRIPTION OF THE DRAWINGS

Embodiments of the invention will now be described by way of example with reference to the drawings, in which.

DETAILED DESCRIPTION OF A PREFERRED EMBODIMENT

Figure 1:
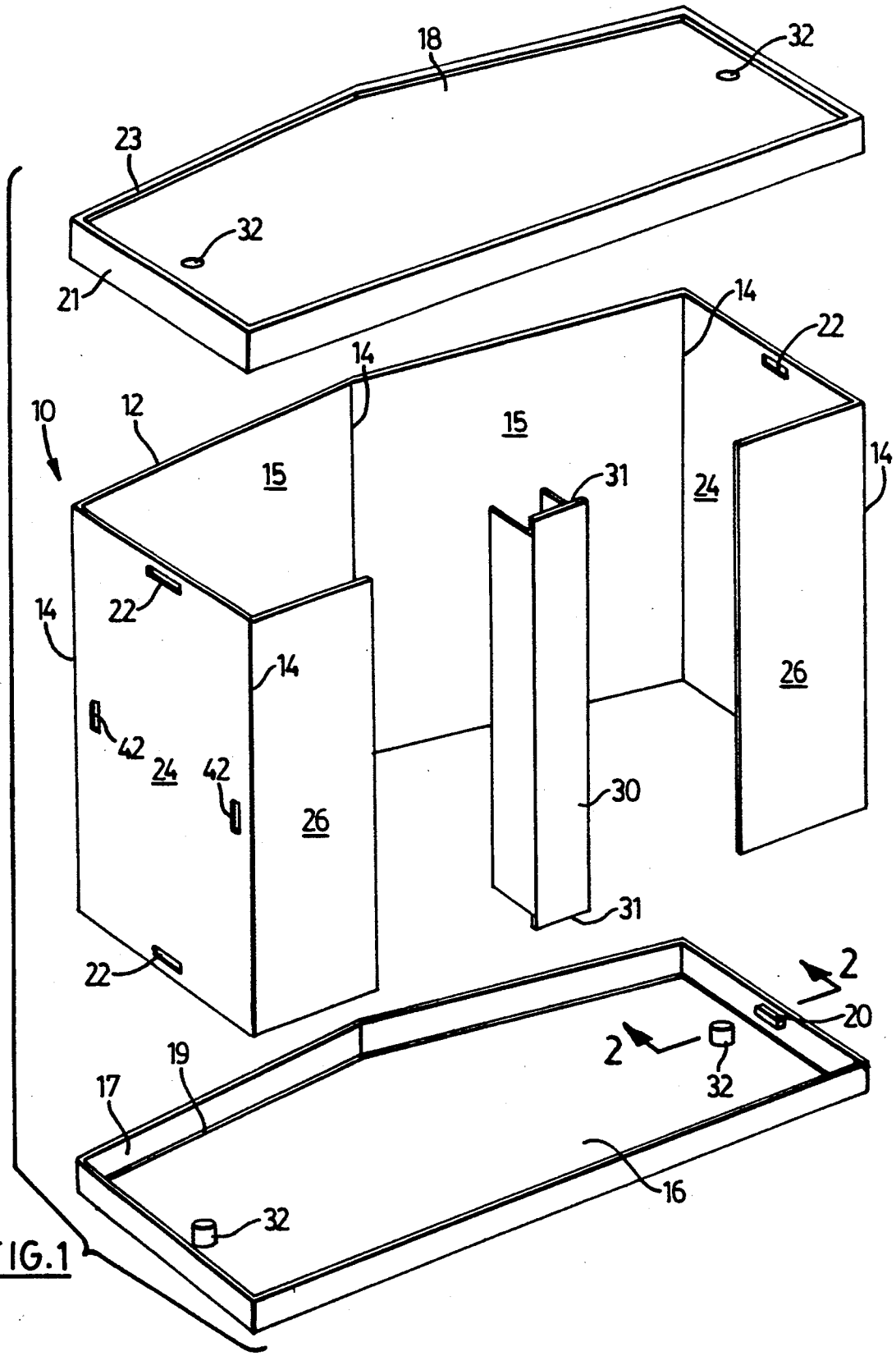
FIG. 1 is an exploded view of a modular display unit which can be linked with another display unit.
Figure 3:
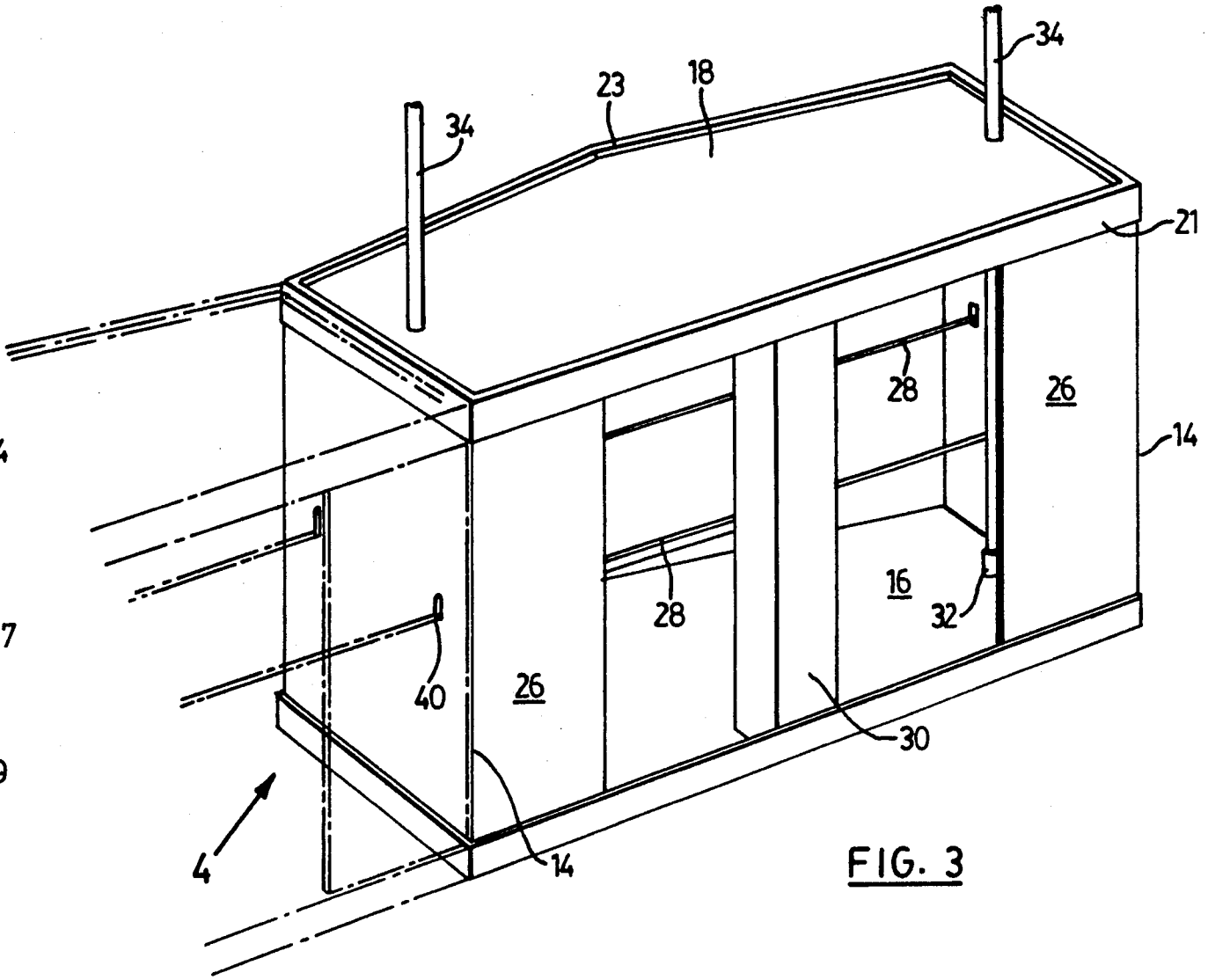
FIG. 3 is a perspective view of the interior of a display unit forming part of an in-line linked system of such display units.

FIGS. 1–5 show a display unit 10 which forms one of the modular units of the present invention comprises an upright sheet 12 of rigid resilient plastics material such as polyethylene or polypropylene. The rigidity should be sufficient so that the sheet is self-supportive when upright. The sheet 12 has coined lines 14 for bending it into the general shape of a suitable display unit. The display unit illustrated has front panels 15 angled one to the other through one of the coined lines 14. It will, however, be appreciated that various shapes of display units may be suitable. The upright portion 12 fits into a lower tray portion 16 and an upper counter top portion 18, both formed of plastics material which again may be polyethylene or polypropylene. It is held firmly in position in the tray portion 16 and the counter top portion 18 by an upstanding lip 17 of the tray and a depending lip 21 of the counter top portion. Additional security for the stable fitting of upright unit 12 into the tray portion 16 may be provided by a channel 19 projecting downwardly from the plane of the tray portion 16 inwardly of upstanding lip 17. The lower edge of upright portion 12 fits into channel 19. Suitably a channel 23 project upwardly of the plane of counter top portion 18 inwardly of lip 21. An upper edge of upright portion 12 fits into channel 23.

Inwardly projecting lugs 20 are located on an inner surface of lips 17 and 21. Lugs 20 engage in slots 22 of upper and lower margins of the upright portion for still further stability. The plastics material should be sufficiently resilient to allow manual engagement of the lugs 20 into the slots 22. Usually it is sufficient that lugs 20 and slots 22 be provided in corresponding side walls of the tray and cover portions and in side panels 24 of the upright portion 12.

The back of the display unit 10 preferably comprises two back wall panels 26 having a space between them so that a person,such as a bartender, standing behind the display counter may have access to the interior.

Inside the display unit a pair of spacer bars 28 extend between the two side panels 24 and may support a shelf 29 of any suitable construction. Thus the shelf may be rigid polyethylene, wood, or preferably plastic coated wire. The spacer bars 28 and shelf 29 together with the interlocking slots 22 and lugs 20 may provide an appreciable degree of strength to the display unit and inhibit any tendency to deform from its desired shape is inhibited.

For greater strength a back strut 30, conveniently of U-section may be located in the gap between back wall panels 26. Conveniently the U-section strut 30 has upper and lower tabs 31 which fit into channels 19 and 23 to maintain the strut in place.

The tray portion 16 and cover portion 18 may be of identical structure and conveniently are injection molded. If greater strength is desired for these portions, strengthening ribs may be incorporated. The tray portion 16 and the cover portion 18 have sockets 32 molded thereinto for the supports of upright poles 34 for elevated advertising material or for an advertising or decorative umbrella. The sockets 12 may be suitably spaced apart such that if two decorative umbrellas are used, they will not foul one another.

The spacing bars 28 may be elongate metal members having hooked ends 40 which hook into slots 42 in the side walls of upright member 12. When it is desired to link two units 10 together in-line as shown in phantom in FIG. 3 the ends 40 are hooked into the slots 42 of adjacent side wall 24 of the display unit 10 which it is desired to link together. The slots 42 may be located equidistant from the top and the bottom of the upright member 12 so that it is immaterial which way up the member is placed. Similarly they may be equidistant from the vertical edges of side panels 24 and from its central vertical line. The hooked ends 40 are U-shaped hooks, the distance between the legs of the U being just sufficient to span the thickness of two side panels 24 so that the panels are held closely together.

It is frequently desirable to link display units 10 at an angle to one another. This may be achieved by means of a joining unit 50 (see FIGS. 6–9).

As may be seen from FIGS. 6–9, the angular joining units 50 may, in principle, be similar to the display units 10. Thus, they may have upright portions 52, tray portions 56, cover portions 58 linked together by lugs of upstanding lips 57 of the tray and depending lips 61 of counter top portions and slots on the upright portion. The upright portion may be made of resilient rigid polyethylene having coined lines 54 where it is desired to bend it into shape.

Each joining unit 50 has a side panel 64 of similar size and shape to side panel 24 of display unit 10. Each side panel 64 includes slots 72 for engagement with hooked ends 40 of shelf support members 28. The hooked ends 40 extend to hook into both slots 42 and slots 72 of joining unit 50.

Figure 6:
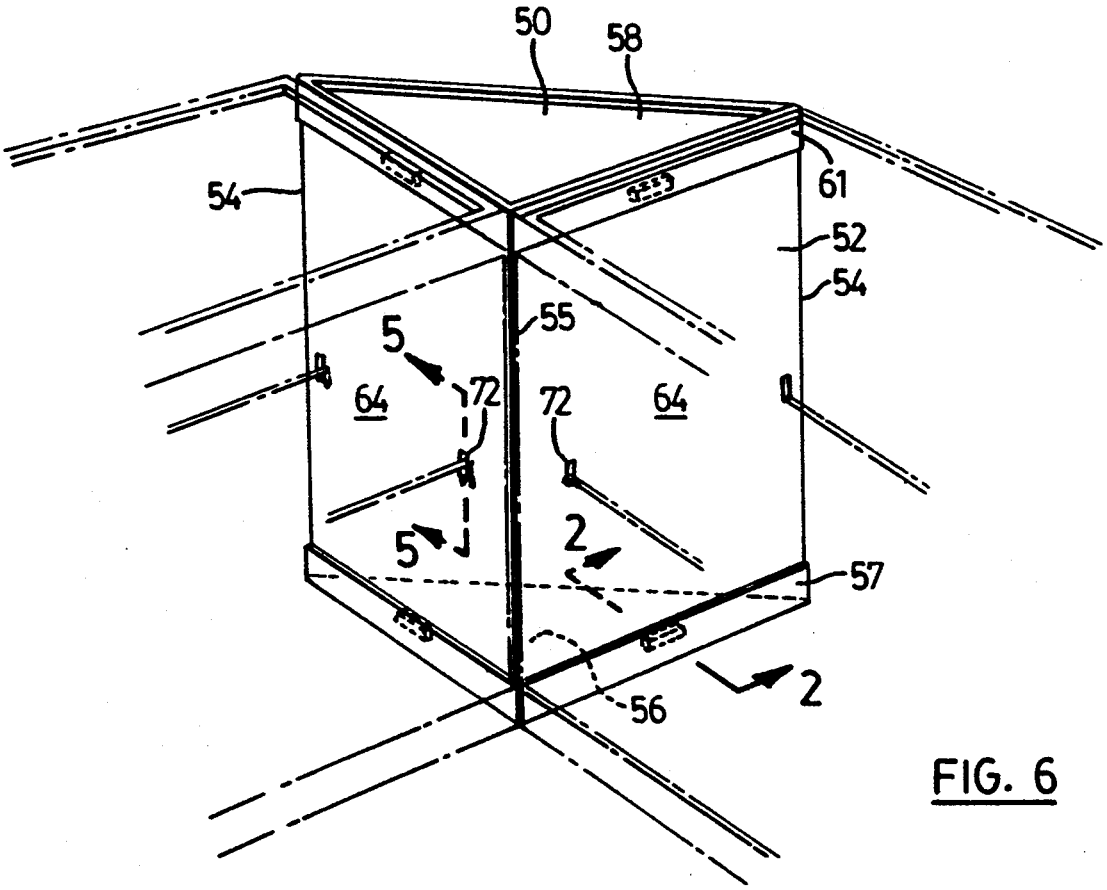
FIG. 6 shows an angular unit for joining two display units at right angles.
Figure 7:
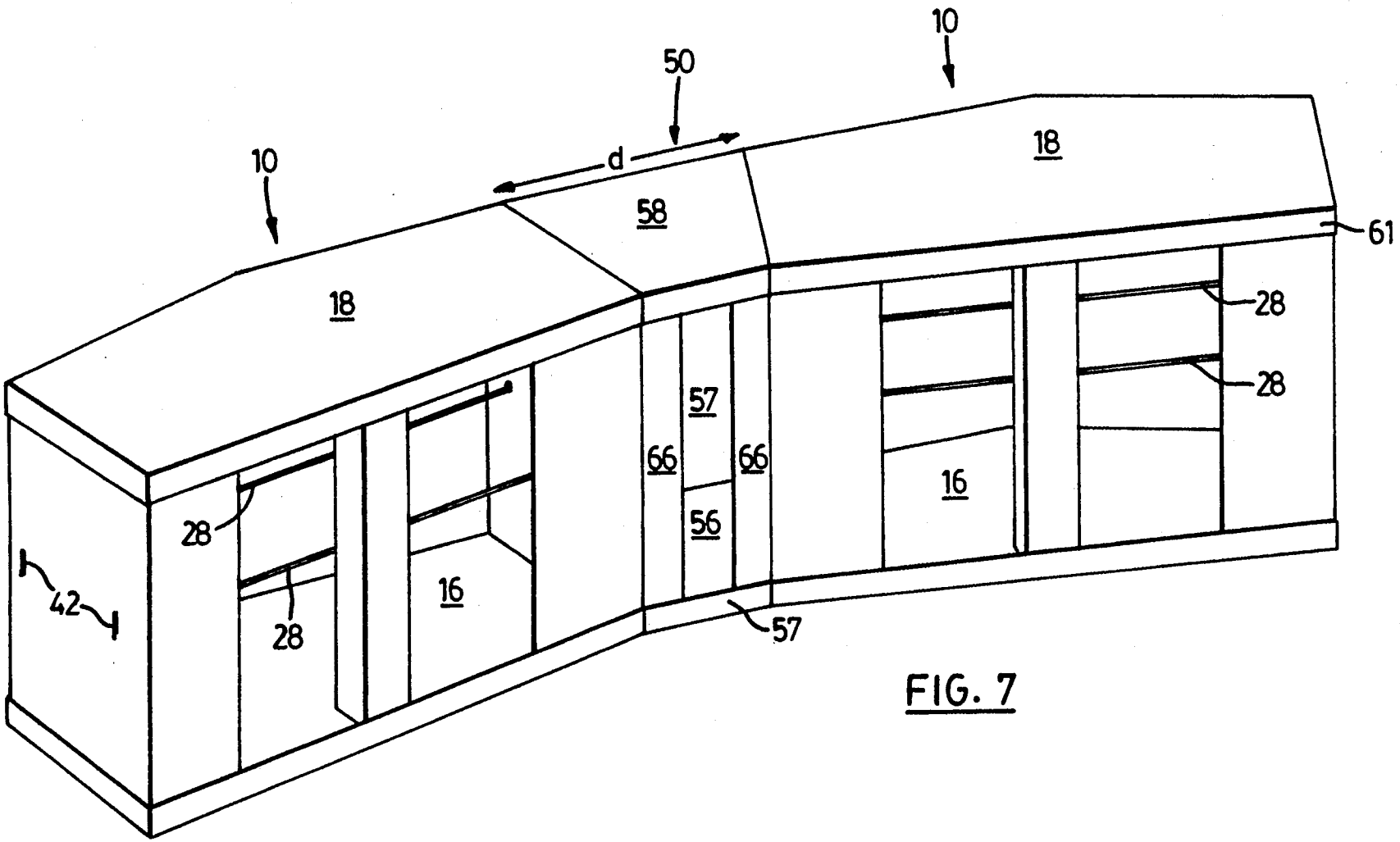
FIG. 7 is a simplified view of an angular joining unit linking two regular units at an angle so that their fronts present a convex figuration, the joining unit having a different angle to that of FIG. 6.

FIG. 6 shows the use of joining unit 50 having a 90 degree angle between its side wall 74 to join two display units 10 at right angles one to the other. In this case upright portion 52 has two coined lines 54 and free edges meet at a back corner 55.

The joining units 50 latch to the display units 10 in a generally similar manner to that described for linking two display units together. Indeed details of the latching of lugs of the joining units and slots of the joining units are identical to those already described. As illustrated, however, the joining units 50 are not provided with spacing bars comparable with spacing bars 28. Therefore only one hooked end 40 of spacing bar 28 of an adjacent display member 10 latches joining unit 50 with the adjacent display unit 10.

The reason for this lack of spacing bars in the joining units 50 is simplicity only. If such bars were provided, they would be of different lengths in different units and an undesirable multiplicity of parts would result. Nevertheless, if they are required in any particular instance they may be provided.

Figure 2:
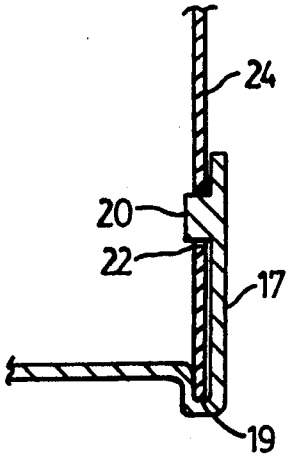
FIG. 2 is a section on the line 2—2 of FIG. 1.
Figure 4:
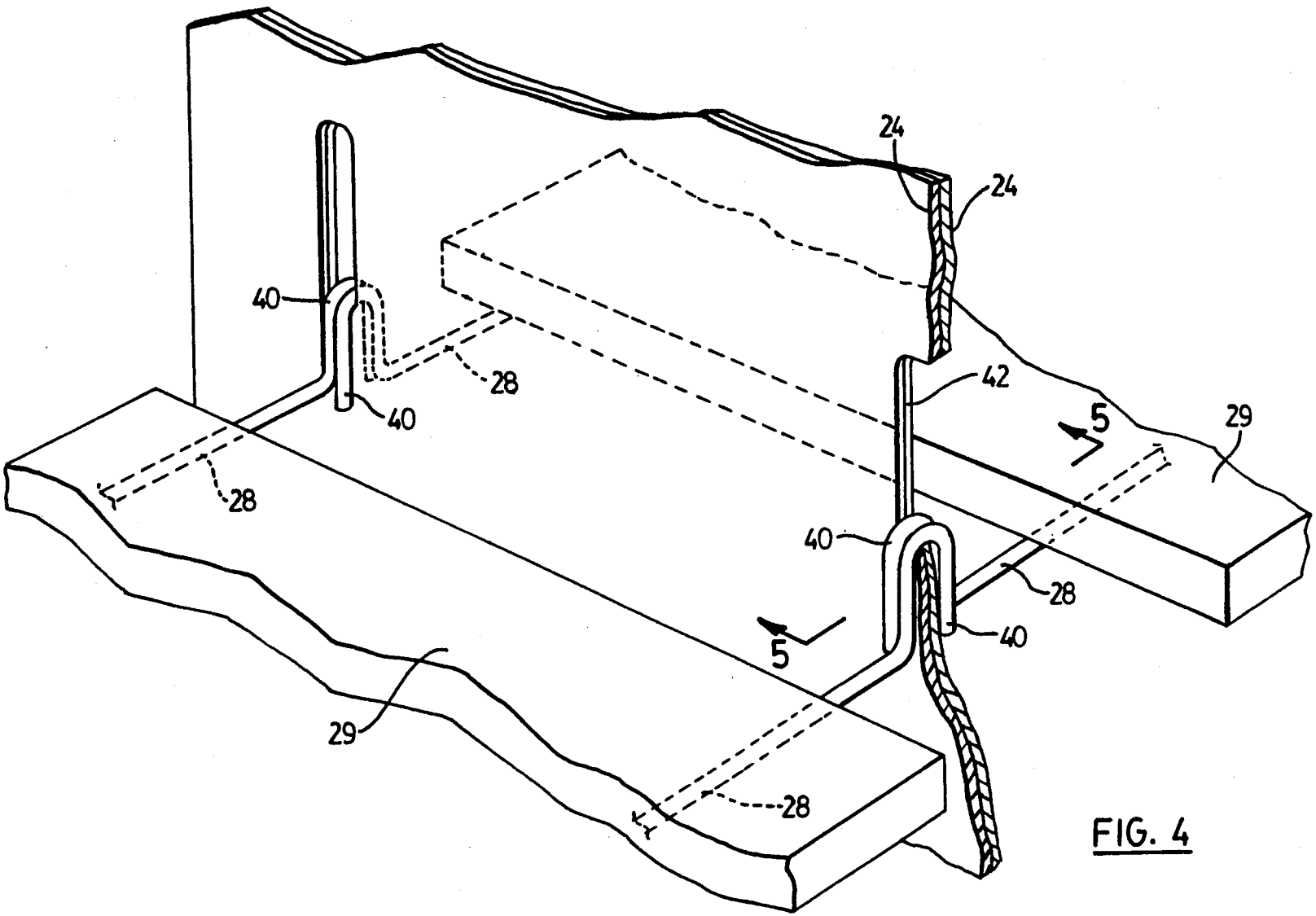
FIG. 4 shows a detail of linking two units together by hooked ends of shelf supports through slots in side walls of the units.
Figure 5:
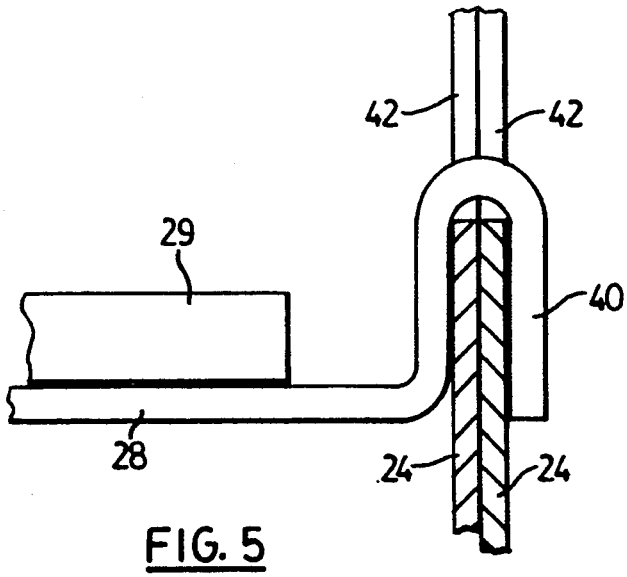
FIG. 5 is a section on the line 5—5 of FIG. 4.

Details of the latching of lugs of the joining units 50 with slots of the joining units 50 and hooked ends 40 of spacing bars 28 are similar to those shown in FIGS. 2 and 5.

Alternative joining units 50 may be provided to join display units 10 at different angles. For example, joining units 50 having side panels 74 at an angle of 45 degrees to each other locate display units 10 at 45 degrees. Examples of the effect of joining units having different angles are shown in the illustrative plan view of FIG. 9.

When the front of an assembly of units is to be convex, it is convenient for the easy positioning of display units 10 to provide joining units 50 which are consistent in their front width. Thus, front panels of the joining unit may have a width of constant length from one coined edge 64 to the other coined edge 64, whatever the angle of the joining unit 50.

Since each of these units has side walls at different angles to each other, only the joining unit 50 which is to join display units 10 at 90 degrees has its side panels 64 meeting at a sharp angle. Joining units 50 whose side panels 64 converge at other angles, have a narrow back wall comprised of two vertical back flaps 66 with an opening therebetween so that a person has access to the interior of the joining unit. Alternatively a narrow back may be wholly open.

Figure 8:
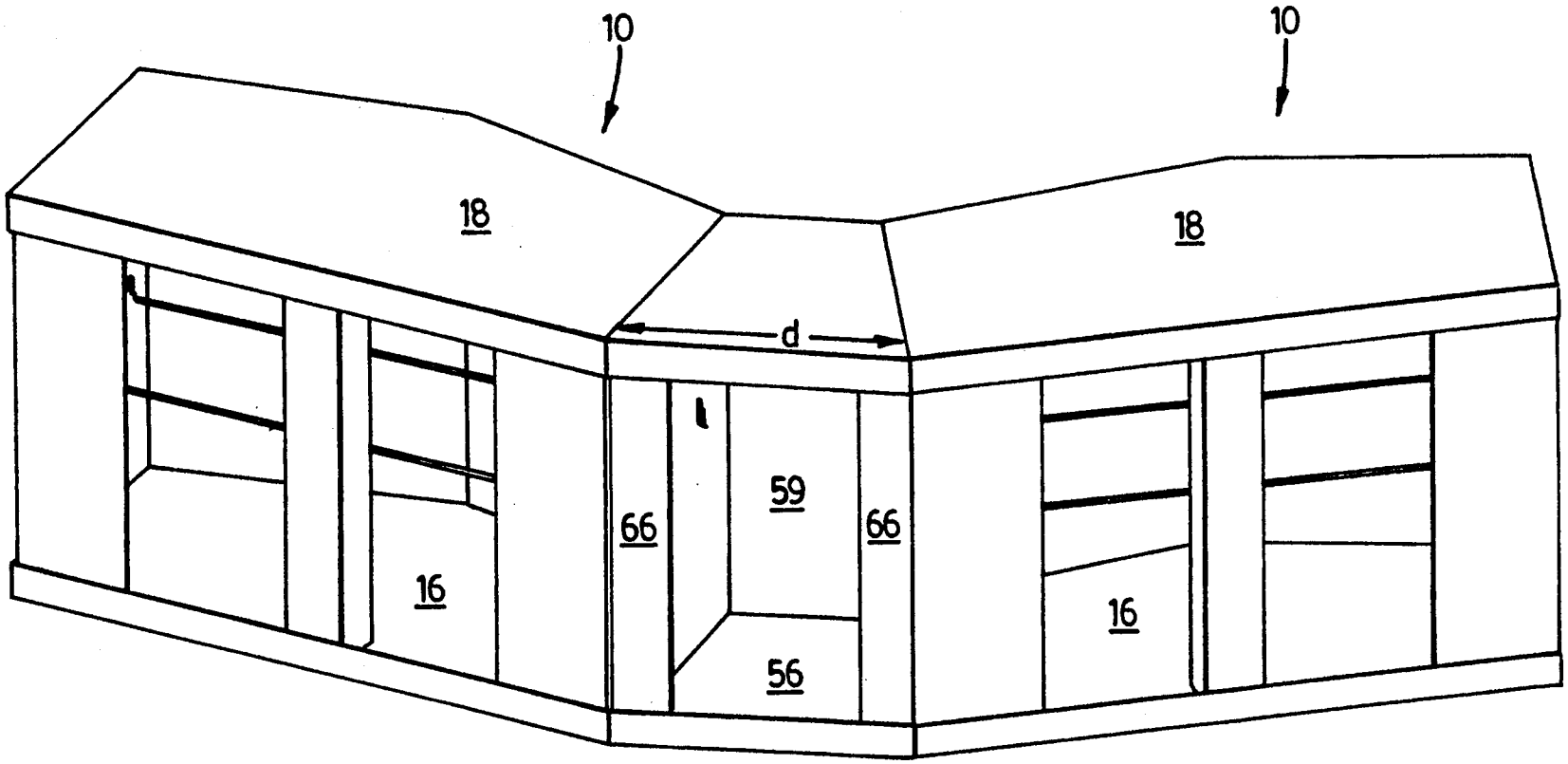
FIG. 8 is a simplified view of modified angular joining unit linking two regular units so that their fronts present a concave curve.
Figure 9:
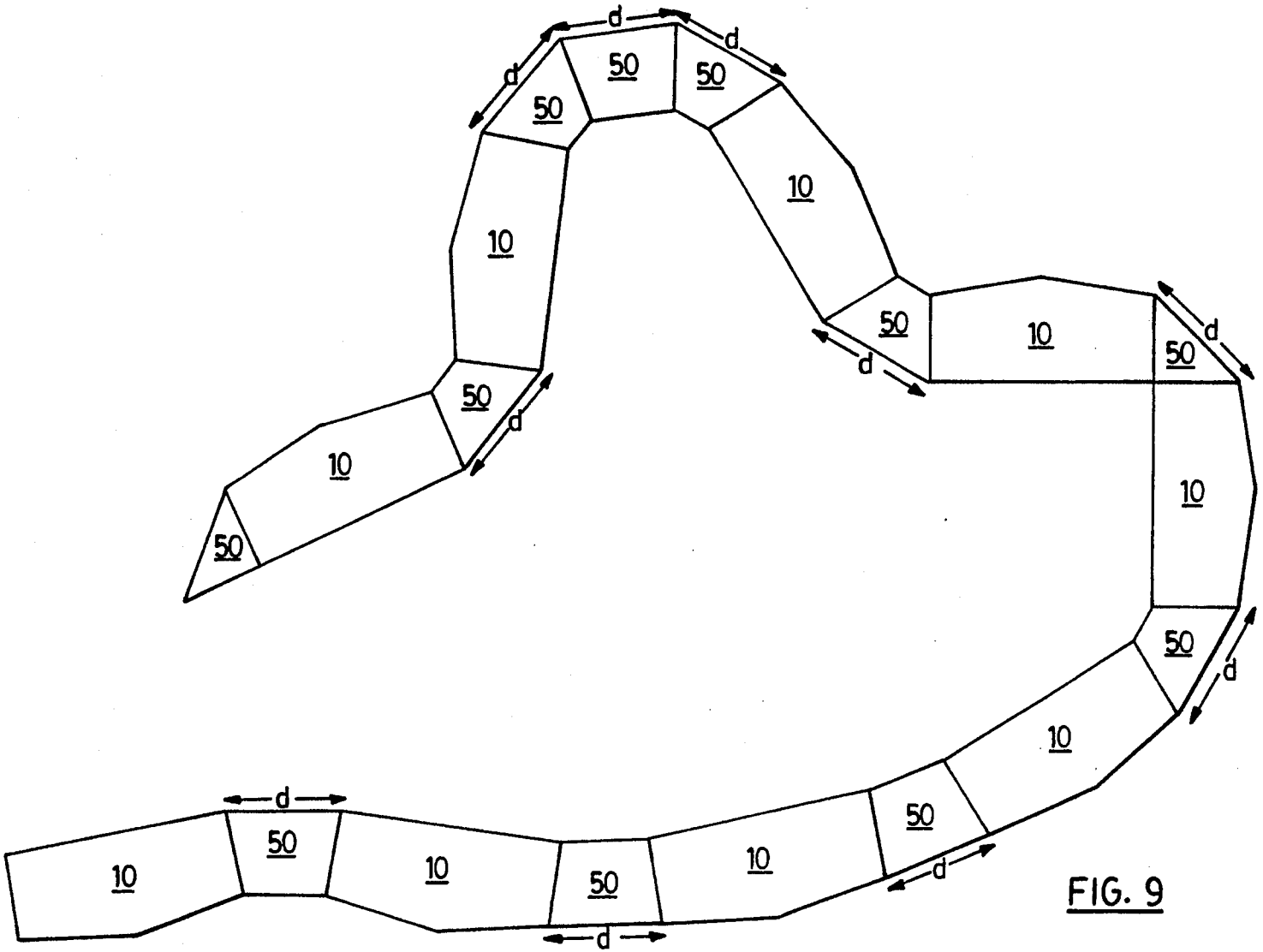
FIG. 9 is a plan view of one layout which may be achieved with a modular system according to the invention.

Sometimes it may be desirable to assemble the system so that display units 10 are angled concavely towards each other. In this case the narrow side 59 of joining unit 50 is the front wall or edge. For aesthetic purposes and for purposes of use it is undesirable that this narrow wall be open. Access is not desired from this side of the display unit. Thus, when joining units are to be used for connecting display units 10 so that their front walls are angled one to the other, the joining units 50 may be modified so that the long wall, which is now the back wall is open for access. Such a unit is shown in FIG. 8.

I claim:

1. A modular display booth assembly comprising:

a plurality of adjacent floor standing display units, a first one of said display units comprising a wide unit including an upright portion of rigid plastics sheet material having at least one front panel, side panels and at least one back panel hinged together through coined hinge lines, a lower tray portion having an upstanding lip confining lower margins of said front, side and back panels, and an upper counter top portion having a depending lip confining upper margins of said front, side and back panels; said upstanding lip and said lower margins being latched through lugs projecting inwardly on said upstanding lip and slots in the lower margins and the upstanding lip; said depending lip and said upper margins being latched through lugs projecting inwardly on said depending lip and slots in said depending lip; at least two spacer bars extending between side panels of said first one of said display units, each of said spacer bars having hooked ends, each of said hooked ends engaging in an aperture in a corresponding one of said side panels of said first one of said display units and into an aperture in a corresponding side panel of a second one of said display units to latch said first and second ones of the display units together;

said second one of said display units comprises a joining unit having a joining front panel having a front width and joining side panels hinged to the front panel through coined hinge lines, at least one joining back panel flush with a back plane of the unit or the back edge having a back plane width less than the front width, a lower tray portion having an upstanding lip confining lower margins of said joining front and joining side panels, and an upper counter top portion having a depending lip confining upper margins of said joining front and joining side panels, at least one of the joining side panels being located adjacent to a side panel of a first one of said display units and being engaged therewith by a hooked end of at least one of the spacer bars of said first one or said second one of said display units engaging in an aperture in said one of said joining side panels.

2. A modular display booth assembly as claimed in claim 1 in which said spacer bars support a shelf within :said first one of said display units.

3. A modular display booth assembly as claimed in claim 1 in which the wide unit has two back panels, each one of the back panels extending from one of said side panels.

4. A modular display booth assembly as claimed in claim 3 in which an access aperture extending between the depending lip and the upstanding lip is provided between the back panels.

5. A modular display booth assembly as claimed in claim 1 in which an upright strengthening strut is provided between the lower tray portion and the counter top portion in the access aperture.

6. A modular display booth assembly as claimed in claim 1 in which the joining side panels of said second one of said display units meet at a vertical corner whereby said second one of said display units has a generally triangular horizontal cross section.

7. A modular display booth assembly as claimed in claim 6 in which the angle between joining side panels of said third one of said display units is substantially 90 degrees.

8. A modular display booth assembly as claimed in claim 1 in which said second one of said display units comprises a joining unit having a joining front edge or a front panel having a front width and joining side panels hinged to the front panel through coined hinge lines, at least one joining back panel flush with a back plane of the unit having a back plane width greater than the width of the front panel; a lower tray portion having an upstanding lip confining lower margins of said joining front and side panels, and an upper counter top portion having a depending lip confining upper margins of said joining front and joining side panels, at least one of the joining side panels being located adjacent to a side panel of a first one of said display units and being engaged therewith by a hooked end of at least one of the spacer bars of said first one of said display units engaging in an aperture of one of the joining side panels and in an aperture of said side panel of said first one of said display units.

9. A kit of modular parts for forming a display booth assembly, the kit comprising parts to form wide units comprising:

a rigid plastics sheet to form an upright portion, the sheet having coined hinge lines defining at least one front panel, side panels and at least one back panel, a number of slots being located in upper and lower margins of at least the side panels, and at least one engagement aperture being located in each one of the side panels;

a lower tray portion having an upstanding lip to confine lower margins of the front, side and back panels, and lugs projecting inwardly of the upstanding lip to engage said slots in the lower margins of at least the side panels;

an upper counter top portion having a depending lip to confine upper margins of the front, side and back panels, and lugs projecting inwardly of the depending lip to engage said slots in the upper margins of at least the side panels;

at least two spacer bars to extend between said side panels, the spacer bars having hooked ends, each one of the hooked ends to engage in both of the engagement apertures of one of said sidewalls and in one of the engagement apertures of one of said side walls of an adjacent display unit;

a shelf to rest on the spacer bars;

and the kit including parts to form a joining display unit, the parts comprising;

a rigid plastics material sheet to form an upright portion, the sheet having coined hinge lines defining at least a joining front panel and joining side panels, a number of slots being located in upper and lower margins of at least the side panels, and at least one engagement aperture being located in each one of the side panels;

a lower tray portion having an upstanding lip to confine lower margins of said joining front and said joining side panels and having lugs projecting inwardly of the upstanding lip to engage said slots in the lower margins of at least the joining side panels; and an upper counter top portion having a depending lip to confine upper margins of said joining front and side panels and having lugs projecting inwardly from the depending lip to engage said slots in the upper margins of at least the joining side panels.

* * * * *